US012435719B2

(12) United States Patent
Okada

(10) Patent No.: US 12,435,719 B2
(45) Date of Patent: Oct. 7, 2025

(54) SCREW COMPRESSOR AND REFRIGERATION APPARATUS

(71) Applicant: DAIKIN INDUSTRIES, LTD., Osaka (JP)

(72) Inventor: Tadashi Okada, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 18/893,655

(22) Filed: Sep. 23, 2024

(65) Prior Publication Data

US 2025/0012280 A1 Jan. 9, 2025

Related U.S. Application Data

(63) Continuation of application No. PCT/JP2023/011543, filed on Mar. 23, 2023.

(30) Foreign Application Priority Data

Mar. 28, 2022 (JP) ..... 2022-051658

(51) Int. Cl.

| | |
|---|---|
| ***F04C 18/16*** | (2006.01) |
| ***F04C 18/48*** | (2006.01) |
| ***F04C 18/50*** | (2006.01) |
| ***F04C 18/52*** | (2006.01) |
| ***F04C 29/00*** | (2006.01) |
| *F25B 31/02* | (2006.01) |

(52) U.S. Cl.

CPC ..... *F04C 18/16* (2013.01); *F04C 18/50* (2013.01); *F04C 18/52* (2013.01); *F04C 29/00* (2013.01);

(Continued)

(58) Field of Classification Search

CPC ..... F04C 18/16; F04C 18/52; F04C 18/50; F04C 29/00; F04C 18/48

See application file for complete search history.

(56) References Cited

U.S. PATENT DOCUMENTS 4,227,867 A 10/1980 Whitehill et al.
7,153,112 B2 * 12/2006 Zarnoch ..... F04C 18/52 418/196

(Continued)

FOREIGN PATENT DOCUMENTS

CN 110114579 A 8/2019
EP 3 546 758 A1 12/2017

(Continued)

OTHER PUBLICATIONS

English GB 2581204 by PE2E Oct. 16, 2024.*

(Continued)

*Primary Examiner* — Deming Wan

(74) *Attorney, Agent, or Firm* — Global IP Counselors, LLP

(57) ABSTRACT

A screw compressor includes a casing, a screw rotor accommodated in the casing to be rotationally driven, and a gate rotor assembly configured to rotate with rotation of the screw rotor. The gate rotor assembly includes a gate rotor including a plurality of flat plate-shaped gates configured to mesh with a helical groove of the screw rotor, and first and second support members. The first support member is made of a metal and includes a plurality of first gate support portions to support corresponding gates from a back surface side. The second support member is made of a metal and includes an annular portion having an annular shape and a plurality of second gate support portions each extending radially toward an outer side from an outer peripheral portion of the annular portion to support corresponding gates from a front surface side.

8 Claims, 13 Drawing Sheets

(52) U.S. Cl.
CPC ..... *F04C 2240/20* (2013.01); *F04C 2250/20* (2013.01); *F25B 31/026* (2013.01)

(56) References Cited

U.S. PATENT DOCUMENTS

| | | | |
|---|---|---|---|
| 2004/0037730 | A1 | 2/2004 | Ueno et al. |
| 2011/0165009 | A1 | 7/2011 | Hossain et al. |
| 2020/0003212 | A1 | 1/2020 | Ueno |

FOREIGN PATENT DOCUMENTS

| | | | | | |
|---|---|---|---|---|---|
| GB | 2581204 | A | * | 8/2020 | ..... F04C 18/084 |
| JP | 50-68906 | U | | 6/1975 | |
| JP | 2002-202080 | A | | 7/2002 | |
| JP | 2009-174520 | A | | 8/2009 | |
| JP | 2010-196582 | A | | 9/2010 | |
| JP | 2019-7399 | A | | 1/2019 | |
| WO | WO-2009084218 | A1 | * | 7/2009 | |

OTHER PUBLICATIONS

English translation of WO 2009084218 by PE2E Mar. 26, 2025.*
International Search Report of corresponding PCT Application No. PCT/JP2023/011543 dated May 16, 2023.
International Preliminary Report of corresponding PCT Application No. PCT/JP2023/011543 dated Oct. 10, 2024.
European Search Report of corresponding EP Application No. 23 78 0059.4 dater May 7, 2025.

* cited by examiner

SCREW COMPRESSOR AND REFRIGERATION APPARATUS

CROSS-REFERENCE TO RELATED APPLICATIONS

This is a continuation of International Application No. PCT/JP2023/011543 filed on Mar. 23, 2023, which claims priority to Japanese Patent Application No. 2022-051658, filed on Mar. 28, 2022. The entire disclosures of these applications are incorporated by reference herein.

BACKGROUND

Technical Field

The present disclosure relates to a screw compressor and a refrigeration apparatus.

Background Art

A compressor that compresses a working fluid is known in the art. Japanese Unexamined Patent Application Publication No. 2019-007399 discloses a screw compressor including a screw rotor on which a plurality of helical grooves are formed and a gate rotor assembly that rotates with rotation of the screw rotor. The gate rotor assembly includes a gate rotor including radially provided gates that mesh with the helical grooves, and a rotor support that supports the gate rotor. In the screw compressor, a compression chamber is formed in the inside of each of the helical grooves by the gate rotor meshing with the helical grooves of the screw rotor. A front surface of the gate rotor faces the compression chamber.

In the gate rotor assembly described in Japanese Unexamined Patent Application Publication No. 2019-007399, the rotor support supports the gate rotor from the back surface side of the gate rotor, thereby ensuring strength of the gate rotor against a pressure that acts in a direction from the front surface toward the back surface of the gate rotor during operation of the screw compressor.

SUMMARY

A first aspect is directed to screw compressor including a casing, a screw rotor accommodated in the casing and configured to be rotationally driven, and a gate rotor assembly configured to rotate with rotation of the screw rotor. The gate rotor assembly includes a gate rotor including a plurality of flat plate-shaped gates each configured to mesh with a helical groove of the screw rotor, and first and second support members. The first support member is made of a metal and includes a plurality of first gate support portions each configured to support a corresponding one of the gates from a back surface side of the corresponding one of the gates, the first support member being configured to support the gate rotor such that the gate rotor is rotatable. The second support member is made of a metal and includes an annular portion having an annular shape and a plurality of second gate support portions each extending radially toward an outer side from an outer peripheral portion of the annular portion and each configured to support a corresponding one of the gates from a front surface side of the corresponding one of the gates. Each of the second gate support portions is configured to support a corresponding one of the gates to reinforce the corresponding one of the gates against a pressure that acts in a direction from a back surface toward a front surface of the corresponding one of the gates. The annular portion and the second support member are formed to be integrated with each other.

DETAILED DESCRIPTION OF EMBODIMENT(S)

Hereinafter, an embodiment of the present disclosure will be described in detail with reference to the drawings. Note that the present disclosure is not limited to the embodiment described below and can be variously changed in a range not deviating from the technical idea of the present disclosure. Since the drawings are intended to conceptually describe the present disclosure, dimensions, ratios, or the number may be exaggerated or simplified, as necessary, for ease of understanding.

Embodiment (1) Overview of Refrigeration Apparatus

Figure 1:
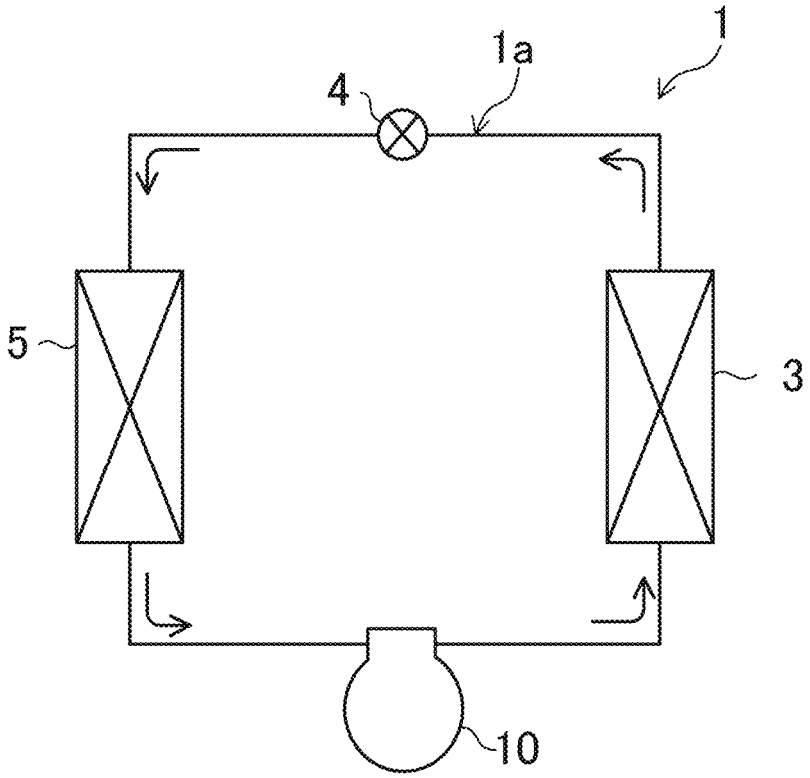
FIG. 1 is a schematic piping system diagram of a refrigeration apparatus according to an embodiment.

As illustrated in FIG. 1, a screw compressor (10) is provided in a refrigeration apparatus (1). The refrigeration apparatus (1) includes a refrigerant circuit (1*a*) filled with a refrigerant. The refrigerant circuit (1*a*) includes the screw compressor (10), a radiator (3), a decompression mechanism (4), and an evaporator (5). The decompression mechanism (4) is an expansion valve. In the refrigerant circuit (1*a*), a vapor compression refrigeration cycle is performed.

In the refrigeration cycle, the refrigerant compressed by the screw compressor (10) dissipates heat into air at the radiator (3). The refrigerant that has dissipated heat is decompressed by the decompression mechanism (4) and evaporates at the evaporator (5). The evaporated refrigerant is sucked into the screw compressor (10).

The refrigeration apparatus (1) is an air conditioning apparatus. The air conditioning apparatus may be an apparatus dedicated to cooling, an apparatus dedicated to heating, or an air conditioning apparatus in which cooling and heating are switched. In this case, the air conditioning apparatus includes a switching mechanism (for example, a four-way switching valve) that switches a circulation direction of the refrigerant. The refrigeration apparatus (1) may be a water heater, a chiller unit, a cooling apparatus that cools air in a chamber, or the like. The cooling apparatus cools air inside a refrigerating chamber, a freezing chamber, a container, or the like.

(2) Screw Compressor

Figure 2:
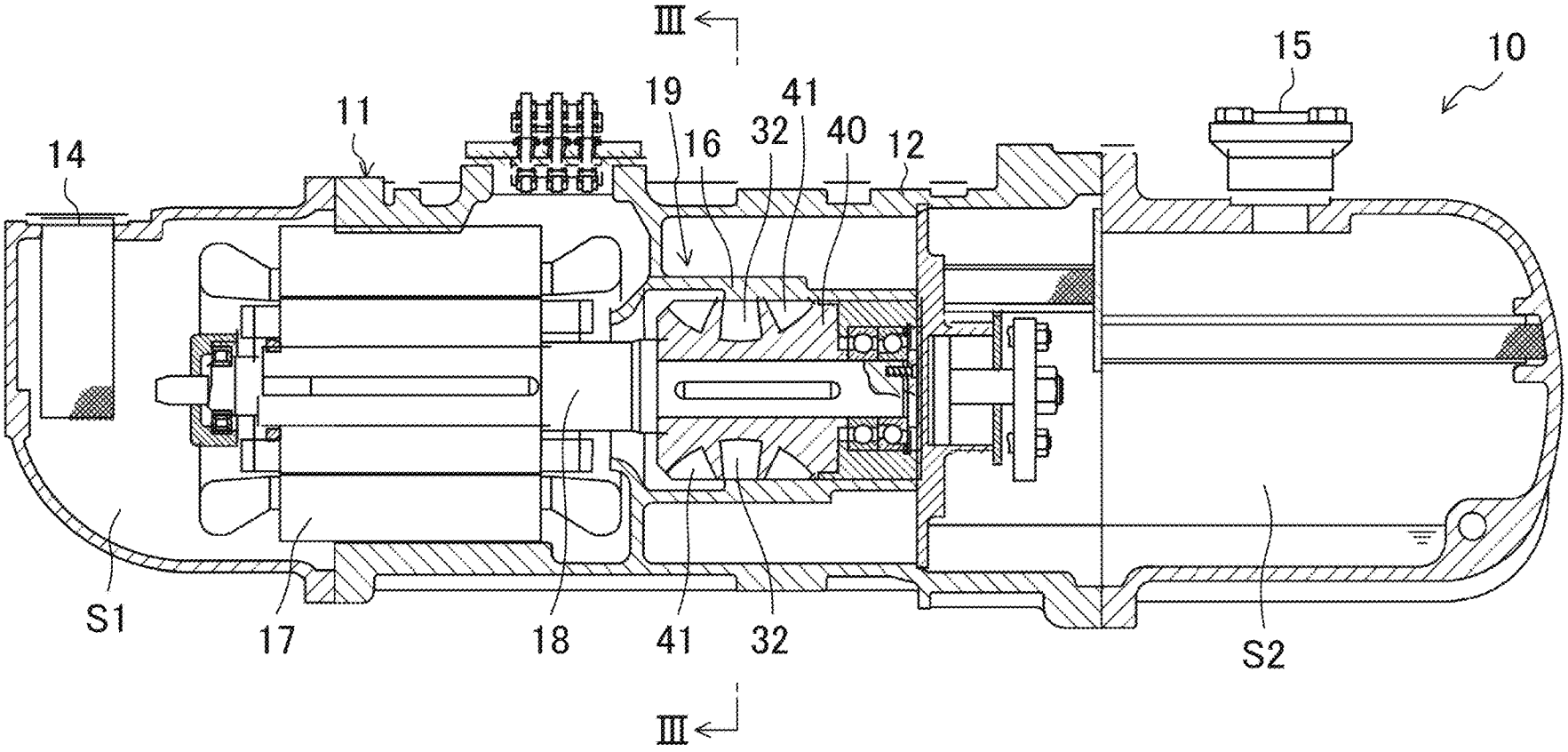
FIG. 2 is a longitudinal sectional view illustrating a general configuration of a screw compressor.
Figure 3:
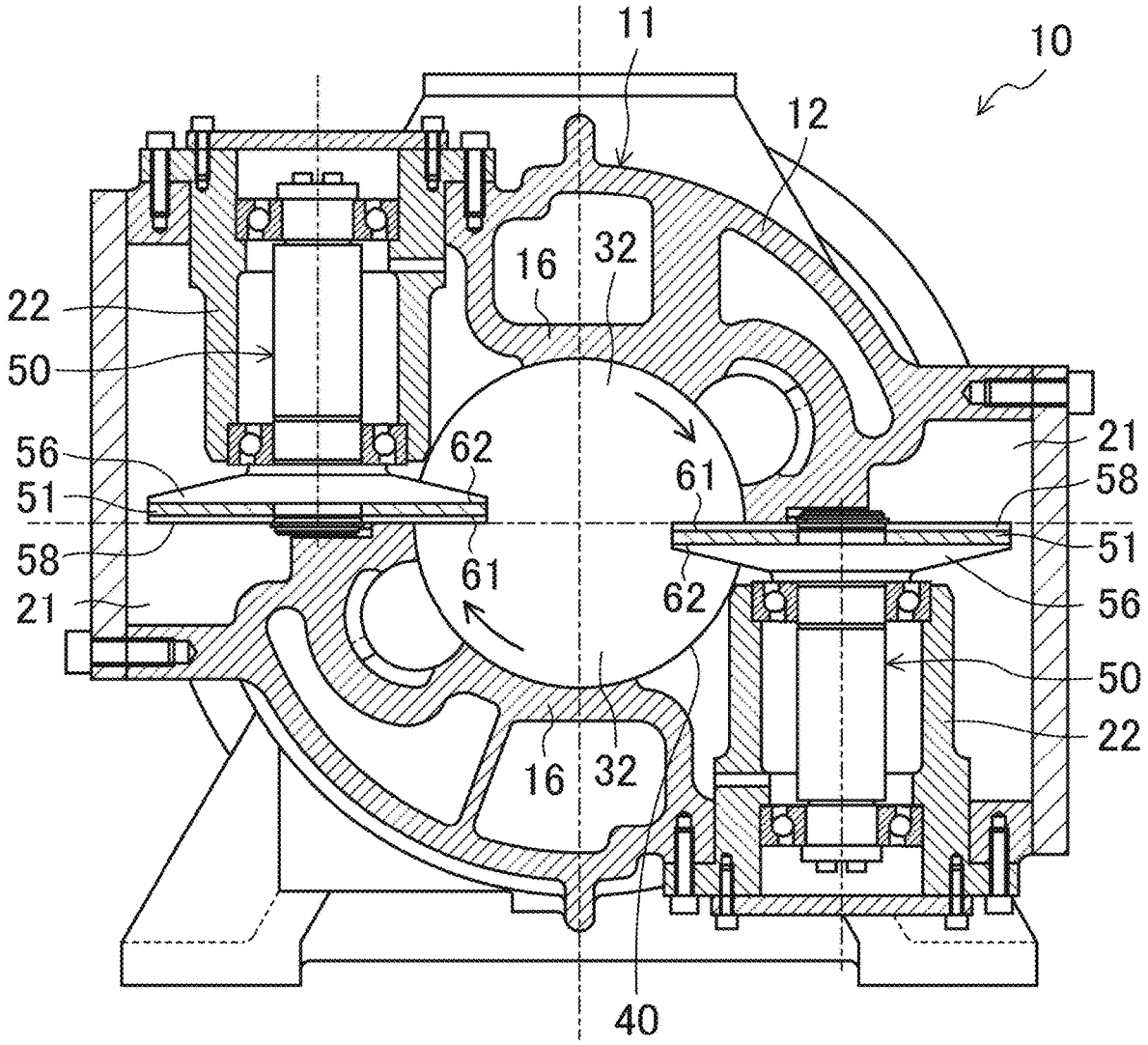
FIG. 3 is a cross-sectional view taken along the line III-III and viewed in the direction of the arrows in FIG. 2.
Figure 4:
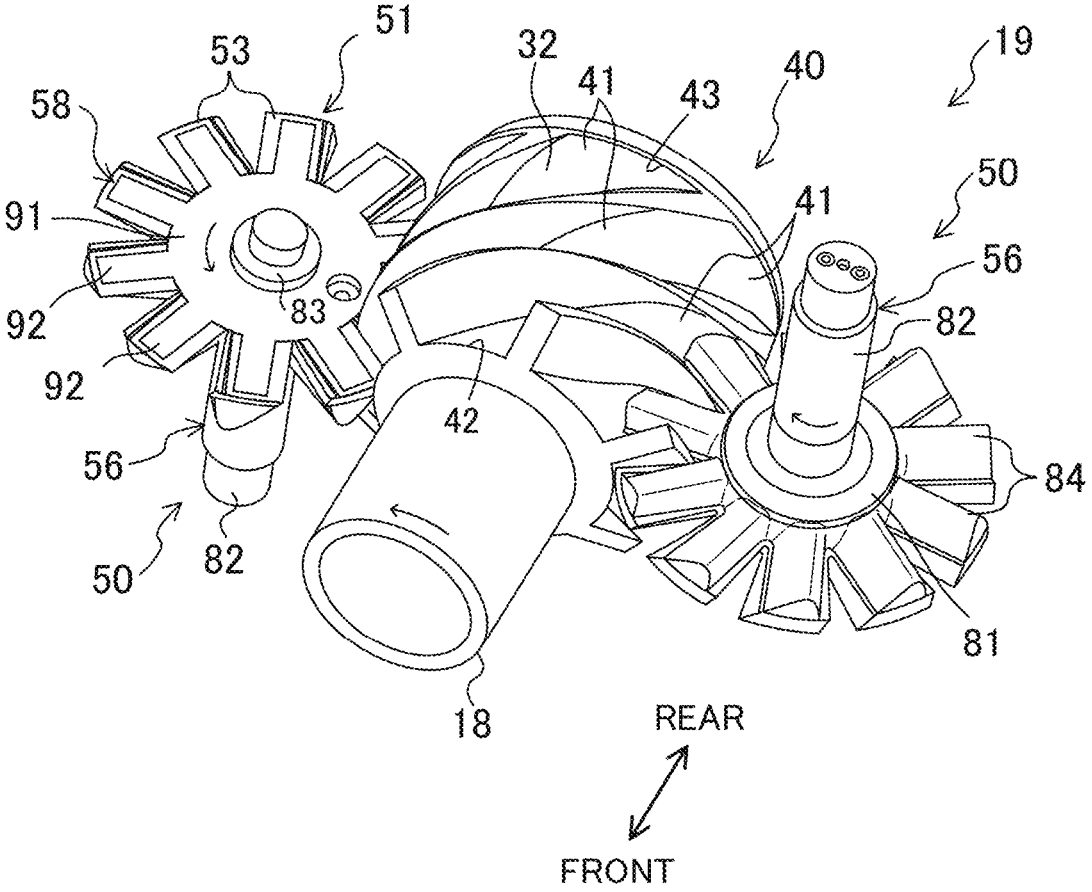
FIG. 4 is a perspective view illustrating a meshing state between a screw rotor and a gate rotor assembly.

The screw compressor (10) in the present embodiment compresses a sucked low-pressure gas refrigerant and discharges a high-pressure gas refrigerant. As illustrated in FIG. 2 to FIG. 4, the screw compressor (10) in the present embodiment is a single-screw compressor including one screw rotor (40). The screw compressor (10) in the present embodiment performs single-stage compression.

(2-1) Overall Configuration

As illustrated in FIG. 2 and FIG. 3, the screw compressor (10) includes a casing (11), an electric motor (17), a drive shaft (18), and a compression mechanism (19). The electric motor (17), the drive shaft (18), and the compression mechanism (19) are accommodated in the casing (11). The compression mechanism (19) includes one screw rotor (40) and two gate rotor assemblies (50).

(2-1-1) Casing

As illustrated in FIG. 2, the casing (11) has a cylindrical shape whose two ends are closed. The casing (11) is disposed in an orientation in which the longitudinal direction thereof is substantially horizontal. The casing (11) includes a body portion (12) and a cylinder portion (16). The body portion (12) has a laterally elongated cylindrical shape whose two ends are closed. The cylinder portion (16) has a substantially cylindrical shape and is disposed in the vicinity of the center of the body portion (12) in the longitudinal direction. The cylinder portion (16) is formed to be integrated with the body portion (12). The inner peripheral surface of the cylinder portion (16) is a cylindrical surface.

A suction port (14) and a discharge port (15) are formed in the body portion (12). The suction port (14) is formed in an upper portion of one end portion (a left end portion in FIG. 2) of the casing (11). The discharge port (15) is formed in an upper portion of another end portion (a right end portion in FIG. 2) of the casing (11).

An internal space of the body portion (12) is partitioned into a low-pressure space (S1) and a high-pressure space (S2). The low-pressure space (S1) is formed closer than the cylinder portion (16) to one end of the body portion (12) and is in communication with the suction port (14). The high-pressure space (S2) is formed closer than the cylinder portion (16) to another end of the body portion (12) and is in communication with the discharge port (15).

(2-1-2) Electric Motor and Drive Shaft

The electric motor (17) is disposed in the low-pressure space (S1). The drive shaft (18) couples the electric motor (17) to the screw rotor (40). The electric motor (17) rotationally drives the screw rotor (40).

(2-1-3) Screw Rotor

As illustrated in FIG. 2, the screw rotor (40) is rotatably accommodated in the cylinder portion (16). As illustrated in FIG. 4, the screw rotor (40) is a columnar member that is made of a metal. The outer peripheral surface of the screw rotor (40) is in sliding contact with the inner peripheral surface of the cylinder portion (16) via an oil film of a lubricating oil. The front side of the screw rotor (40) in FIG. 4 is located on the side of the low-pressure space (S1), and the rear side of the screw rotor (40) in FIG. 4 is located on the side of the high-pressure space (S2).

A plurality (six in the present embodiment) of helical grooves (41) are formed on an outer peripheral portion of the screw rotor (40). Each of the helical grooves (41) is a groove helically extending in the circumferential direction and the axial direction of the screw rotor (40). The six helical grooves (41) are disposed at equal angular intervals in the circumferential direction of the screw rotor (40). In each of the helical grooves (41) of the screw rotor (40), an end on one end side (front end side in FIG. 4) of the drive shaft (18) serves as a suction-side end (42), and an end on another end side (rear end side in FIG. 4) of the drive shaft (18) serves as a discharge-side end (43).

An end portion of the screw rotor (40) on the suction side (the side of low-pressure space (S1)) has a tapered shape. In the screw rotor (40) illustrated in FIG. 4, the suction-side ends (42) of the helical grooves (41) are open at the end surface of the screw rotor (40) on the suction side while the discharge-side ends (43) of the helical grooves (41) are not open at the end surface of the screw rotor (40) on the discharge side.

(2-1-4) Gate Rotor Assembly

As illustrated in FIG. 3, each of the gate rotor assemblies (50) is rotatably attached to the body portion (12) of the casing (11). Each of the gate rotor assemblies (50) includes one gate rotor (51), one first support member (56), and one second support member (58). In the gate rotor assembly (50), the first support member (56), the gate rotor (51), and the second support member (58) are stacked in this order. The gate rotor (51) is sandwiched and held between the first support member (56) and the second support member (58).

The gate rotor (51) is a circular flat plate-shaped member that is made of a resin. As illustrated in FIG. 4, a plurality (ten in the present embodiment) of gates (53) are radially provided on the gate rotor (51). Each of the gates (53) is a substantially rectangular flat plate-shaped portion. In the present embodiment, the gate rotor (51) is constituted by a plurality of gate blocks (70) in which the gates (53) are formed separately from each other. Details of the structure of the gate rotor (51) will be described later.

Each of the gates (53) enters each helical groove (41) of the screw rotor (40) and form a compression chamber (32) by sliding on the wall surface of the helical groove (41). A front surface (61) of the gate rotor (51) is a surface on the side of the compression chamber (32). A back surface (62) of the gate rotor (51) is a surface opposite to the front surface (61).

The first support member (56) is a member that is made of a metal. The first support member (56) is provided in contact with the back surface (62) of the gate rotor (51) and supports the gate rotor (51). The second support member (58) is a flat plate-shaped member that is made of a metal. The second support member (58) is provided in contact with the front surface (61) of the gate rotor (51) and supports the gate rotor (51). Details of the structures of the first support member (56) and the second support member (58) will be also described later.

Gate rotor chambers (21) are formed one each on the left and right sides of the cylinder portion (16) illustrated in FIG. 3. The gate rotor assemblies (50) are accommodated one each in the gate rotor chambers (21). Each of the gate rotor chambers (21) is in communication with the low-pressure space (S1).

Specifically, each of the gate rotor chambers (21) is provided with a bearing housing (22). The bearing housing (22) is a cylindrical member that is made of a metal. The bearing housing (22) is fixed to the body portion (12) of the casing (11). Each of the gate rotor assemblies (50) is rotatably supported by the bearing housing (22) via a bearing.

In FIG. 3, the front surface (61) of the gate rotor (51) of the gate rotor assembly (50) disposed on the right side of the screw rotor (40) faces upward. In FIG. 3, the front surface (61) of the gate rotor (51) of the gate rotor assembly (50) disposed on the left side of the screw rotor (40) faces downward. The two gate rotor assemblies (50) are disposed in orientations in which the gate rotor assemblies (50) are axially symmetric with respect to the axis of the screw rotor (40). The axis of each of the gate rotor assemblies (50) extends in a plane perpendicular to the axis of the screw rotor (40).

The gate rotor assemblies (50) are disposed to extend through the cylinder portion (16). The gate rotor assemblies (50) rotate with rotation of the screw rotor (40). Then, the rotation of the gate rotor assemblies (50) causes the gates (53) of the gate rotor (51) to enter the helical grooves (41) of the screw rotor (40) and mesh with the screw rotor (40).

(2-1-5) Compression Chamber

As illustrated in FIG. 2 and FIG. 3, the compression chamber (32) (hereinafter also referred to as the high-pressure chamber) is formed in the screw compressor (10) by the screw rotor (40), the gate rotor (51), and the cylinder portion (16) of the casing (11). The compression chamber (32) is a closed space surrounded by the wall surfaces of the helical grooves (41) of the screw rotor (40), the front surfaces (61) of the gates (53) of the gate rotor (51), and the inner peripheral surface of the cylinder portion (16). In the helical grooves (41), a space formed opposite to the compression chamber (32) with the gates (53) interposed therebetween serves as a low-pressure chamber. The low-pressure chamber is a space in which a pressure is lower than the pressure in the compression chamber (32).

(2-2) Details of Configuration of Gate Rotor Assembly

Details of the configuration of each gate rotor assembly (50) will be described in detail with reference to FIG. 3 to FIG. 9. In the following description, the "axial direction" refers to the direction in which the axis of a first shaft portion (82) of the first support member (56) extends, the "radial direction" refers to the direction orthogonal to the axis of the first shaft portion (82), and the "circumferential direction" refers to the circumferential direction based on the axis of the first shaft portion (82). In the following description, the "front surface" refers to a surface on the side of the compression chamber (32), and the "back surface" refers to a surface on the side of the low-pressure chamber.

(2-2-1) Gate Rotor

Figure 6:
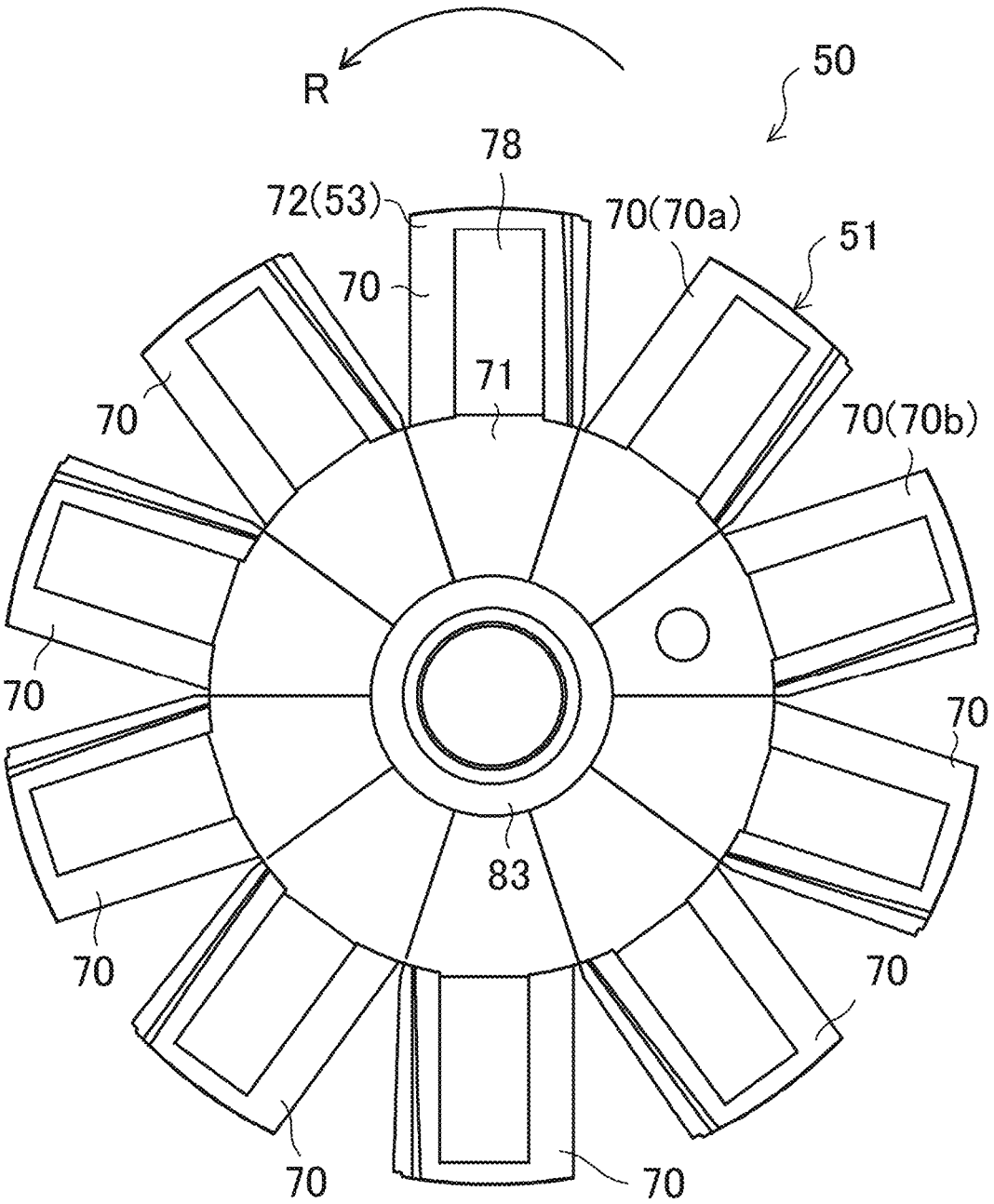
FIG. 6 is a plan view illustrating a state in which a gate rotor is assembled to a first support member.

As illustrated in FIG. 6, the gate rotor (51) is constituted by a plurality (ten in the present embodiment) of the gate blocks (70) that extend radially. The gate blocks (70) include a first gate block (70*a*) including one gate (53) and a second gate block (70*b*) including one gate (53). Each of the gate blocks (70) is made of a resin. Each of the gate blocks (70) is manufactured by injection molding. Each of the gate blocks (70) may be machined after molded by injection molding.

Each of the gate blocks (70) in the present embodiment includes one base portion (71) and one gate portion (72).

Each base portion (71) is a portion of the gate block (70) close to the axis of the gate rotor assembly (50). Each of the base portions (71) has a substantially trapezoidal shape so that side surfaces of the base portions (71) adjacent to each other are in surface contact with each other.

The gate portion (72) is a portion extending toward the outer side in the radial direction from an outer peripheral portion of the base portion (71). The gate portion (72) constitutes the gate (53) of the gate rotor (51). The gate portion (72) has a substantially rectangular shape so as to mesh with each helical groove (41) of the screw rotor (40). In the gate portion (72) in the present embodiment, the width of the gate portion (72) is substantially constant from the inner side toward the outer side in the radial direction of the gate rotor (51).

Figure 7:
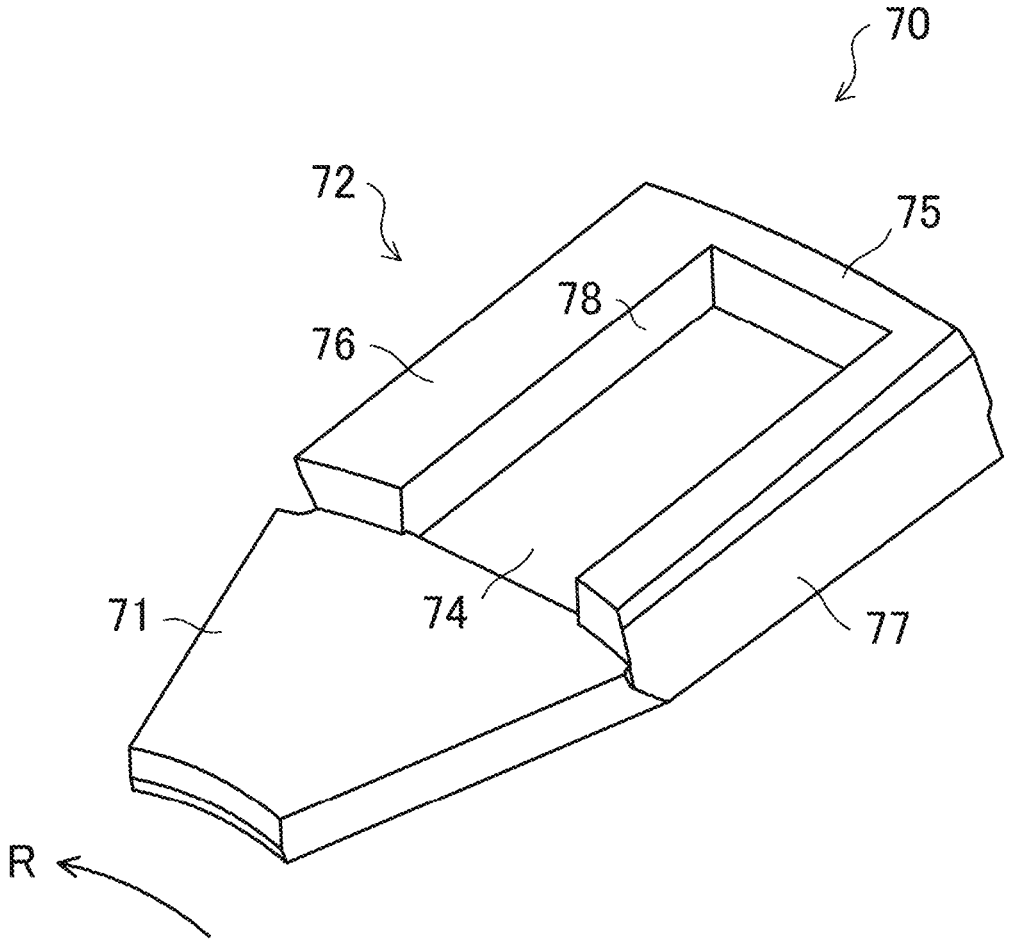
FIG. 7 is a perspective view of a gate block.
Figure 9:
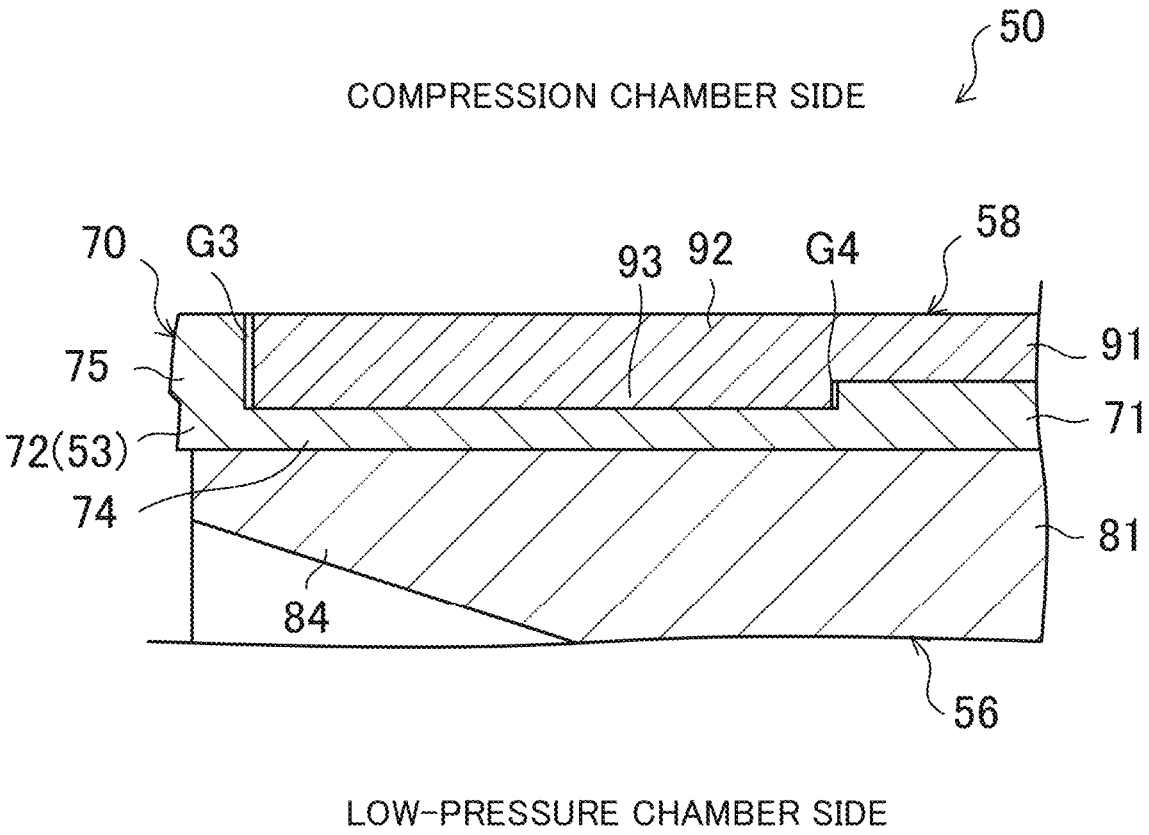
FIG. 9 is a cross-sectional view taken along the line IX-IX and viewed in the direction of the arrows in FIG. 8.

As illustrated in FIG. 7, the gate portion (72) is constituted by a bottom surface portion (74), a leading-end wall portion (75), a front side wall portion (76), and a rear side wall portion (77). The bottom surface portion (74) is a planar portion extending toward the outer side in the radial direction from the base portion (71). As illustrated in FIG. 9, the thickness of the bottom surface portion (74) is thinner than the thickness of the base portion (71). In other words, the bottom surface portion (74) is lowered by one step from the base portion (71).

The leading-end wall portion (75) is provided at a leading end portion of the bottom surface portion (74). The leading-end wall portion (75) protrudes from the bottom surface portion (74) toward the second support member (58) (upward in FIG. 9). The front side wall portion (76) is provided at a side edge portion of the bottom surface portion (74) on the front side in a rotation direction R of the gate rotor (51). The front side wall portion (76) protrudes from the bottom surface portion (74) toward the second support member (58). The rear side wall portion (77) is provided at a side edge portion of the bottom surface portion (74) on the rear side in the rotation direction R of the gate rotor (51). The rear side wall portion (77) protrudes from the bottom surface portion (74) toward the second support member (58).

The gate portion (72) includes a concave portion (78). The concave portion (78) is a portion surrounded by the bottom surface portion (74), the leading-end wall portion (75), the front side wall portion (76), and the rear side wall portion (77) of the gate portion (72). A bottom portion of the concave portion (78) has a substantially rectangular shape. The concave portion (78) is recessed toward the first support member (56).

(2-2-2) First Support Member

As illustrated in FIG. 3 and FIG. 4, the first support member (56) includes a disk portion (81), a first shaft portion (82), a second shaft portion (83), and a plurality of first gate support portions (84).

The disk portion (81) is a portion having a slightly thick disk shape. The first shaft portion (82) is a portion having a round rod shape. The first shaft portion (82) is provided on the back surface side of the disk portion (81). The first shaft portion (82) extends from a central portion of the disk portion (81). The axis of the first shaft portion (82) coincides with the axis of the disk portion (81).

The second shaft portion (83) is a portion having a columnar shape. The second shaft portion (83) is provided on the front surface side of the disk portion (81). The second shaft portion (83) extends from a central portion of the disk portion (81). The axis of the second shaft portion (83) coincides with the axis of the first shaft portion (82). The axis of the second shaft portion (83) coincides with the axis of the disk portion (81). The cross-sectional area of the second shaft portion (83) is smaller than the cross-sectional area of the first shaft portion (82). The gate rotor (51) and the second support member (58) are fitted to the second shaft portion (83). The gate blocks (70) of the gate rotor (51) are arranged to surround the second shaft portion (83).

A groove (not illustrated) is formed, on the outer peripheral surface of the second shaft portion (83), at a position close to the compression chamber (32). Specifically, on the second shaft portion (83), the groove is formed at a position closer than the position where the second support member (58) is disposed to the compression chamber (32). The groove is formed over the entire circumference of the second shaft portion (83). A stopper ring (for example, a circlip) is fitted into the groove. With the stopper ring fitted into the groove, movement of each of the gate blocks (70) and the second support member (58) in the axial direction is restricted. In other words, the stopper ring restricts movement of the second support member (58) in the axial direction, thereby restricting movement of each of the gate blocks (70), which are sandwiched between the first support member (56) and the second support member (58), in the axial direction.

The first support member (56) includes the same number (ten in the present embodiment) of the first gate support portions (84) as the number of the gates (53) of the gate rotor (51). The first gate support portions (84) are portions extending radially toward the outer side in the radial direction from an outer peripheral portion of the disk portion (81). Each of the first gate support portions (84) extends along the back surface of a corresponding one of the gate portions (72).

As illustrated in FIG. 9, each of the first gate support portions (84) covers substantially the entirety of the back surface of the corresponding gate portion (72). Each of the first gate support portions (84) supports, in a state of being in contact with the back surface of the corresponding gate portion (72), the corresponding gate portion (72) from the back surface side. Each of the first gate support portions (84) is formed to have a substantially triangular cross-section perpendicular to an extending direction thereof.

Since each first gate support portion (84) supports the gate portion (72) corresponding to the first gate support portion (84) from the back surface side, it is possible to ensure strength against a pressure that acts due to compression of the refrigerant in the compression chamber (32) during operation of the screw compressor (10) and that is in a direction from the front surface (61) toward the back surface (62) of the gate rotor (51).

(2-2-3) Second Support Member

Figure 5:
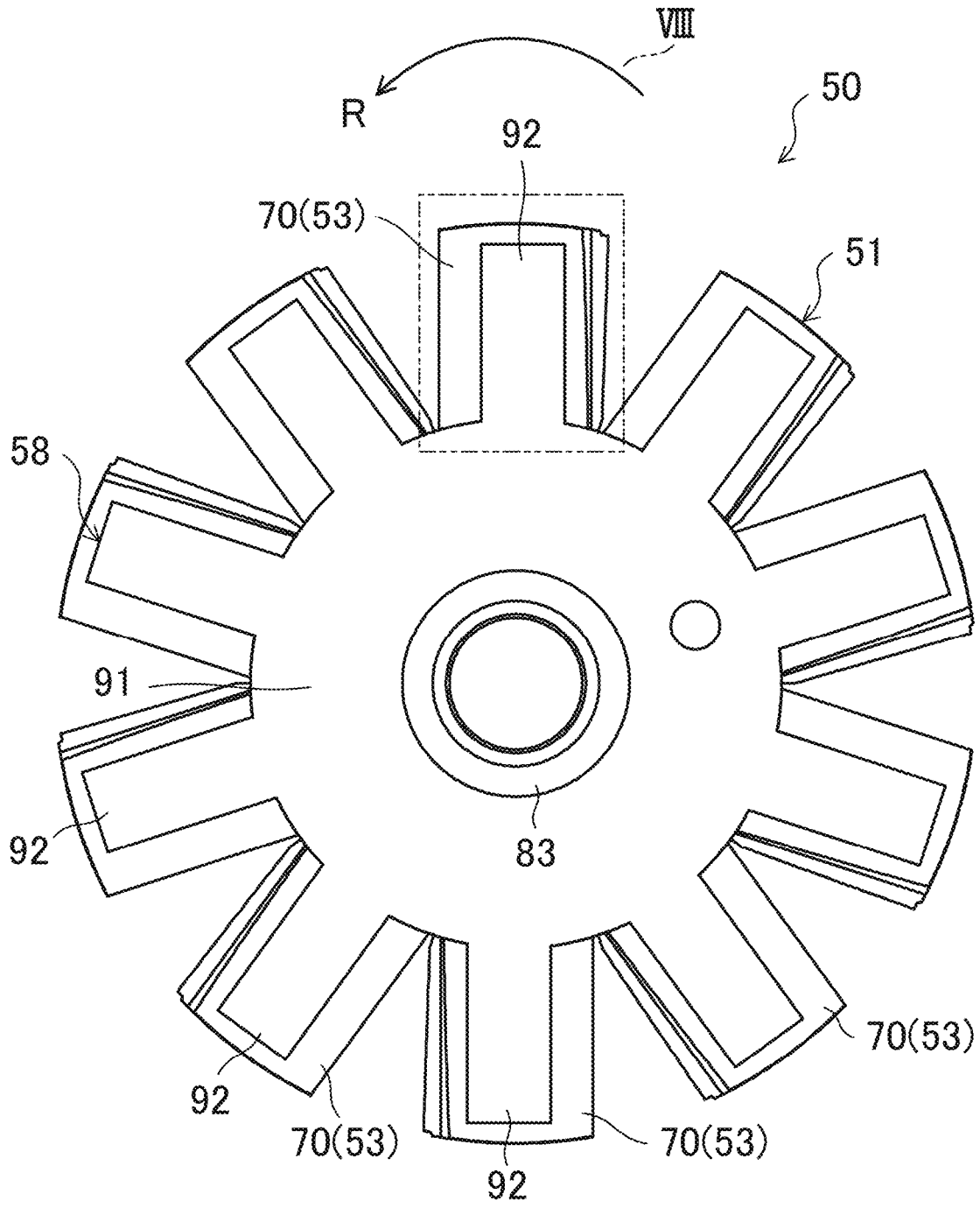
FIG. 5 is a plan view of a gate rotor assembly.

As illustrated in FIG. 4 and FIG. 5, the second support member (58) includes an annular portion (91) and a plurality of second gate support portions (92).

The annular portion (91) is a portion having an annular shape. The second shaft portion (83) of the first support member (56) is inserted into a hole formed at the center of the annular portion (91). The second support member (58) includes the same number (ten in the present embodiment) of the second gate support portions (92) as the number of the gates (53) of the gate rotor (51). The second gate support portions (92) are each a portion extending radially toward the outer side in the radial direction from an outer peripheral portion of the annular portion (91). Each of the second gate support portions (92) extends along the front surface of a corresponding one of the gate portions (72). Each of the second gate support portions (92) supports, in a state of being in contact with the front surface of the corresponding gate portion (72), the corresponding gate portion (72) from the front surface side.

Since each second gate support portion (92) supports the gate portion (72) corresponding to the second gate support portion (92) from the front surface side, it is possible to increase strength against a pressure that is generated during operation of the screw compressor (10) in a rare case from the side of the back surface (62) of the gate rotor (51). Consequently, it is possible to reduce damage to the gate rotor (51) caused by a pressure applied in a direction from the back surface (62) toward the front surface (61) of the gate rotor (51), that is, in a direction opposite to a normal direction.

Figure 8:
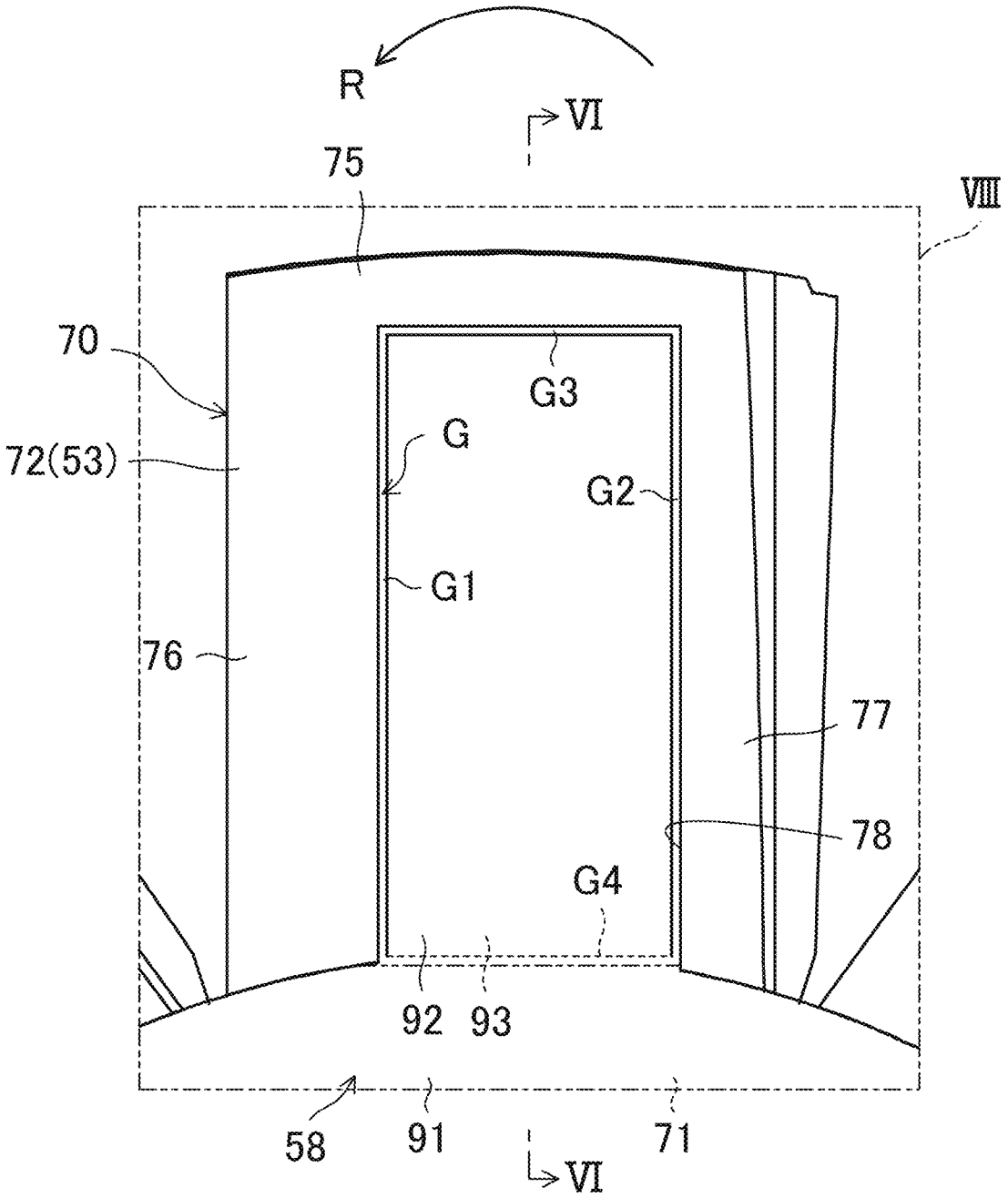
FIG. 8 is an enlarged plan view of a gate block of a gate rotor assembly.

As illustrated in FIG. 9, the second gate support portions (92) each include a protruding portion (93). The protruding portion (93) is a portion protruding toward the gate portion (72). In other words, the thickness of each second gate support portion (92) is larger than the thickness of the annular portion (91). As illustrated in FIG. 8, the protruding portion (93) has a substantially rectangular shape. The protruding portion (93) engages with the concave portion (78) of the gate portion (72). The protruding portion (93) is in surface contact with a bottom portion of the concave portion (78). The area of the protruding portion (93) is smaller than the area of the bottom portion of the concave portion (78).

Since the protruding portion (93) engages with the concave portion (78) of the gate portion (72) as described above, it is possible to restrict large movement of the gate block (70) in the circumferential direction and the radial direction.

(2-2-4) Gap

As illustrated in FIG. 8, a slight gap (G) is formed between the inner peripheral surface of the concave portion (78) and the outer peripheral surface of the protruding portion (93) so as to surround the entire circumference of the protruding portion (93). Specifically, the gap (G) is constituted by a first gap (G1), a second gap (G2), a third gap (G3), and a fourth gap (G4).

The first gap (G1) is formed between the inner side surface of the front side wall portion (76) and the front side surface of the protruding portion (93). The second gap (G2) is formed between the inner side surface of the rear side wall portion (77) and the rear side surface of the protruding portion (93). The third gap (G3) is formed between the inner side surface of the leading-end wall portion (75) and the leading-end side surface of the protruding portion (93). The fourth gap (G4) is formed between the leading end surface of the base portion (71) and the base-end side surface of the protruding portion (93).

Here, during operation of the screw compressor (10), components constituting the screw compressor (10) thermally expand due to compression heat generated with compression of a refrigerant. In this case, the positions of the bearing housings (22) supporting the gate rotor assemblies (50) change with thermal expansion of the body portion (12) of the casing (11). With changes in the positions of the bearing housings (22), the position of the gate rotor (51) also changes. Consequently, the relative positions of the screw rotor (40) and the gate rotor (51) are shifted. When the relative positions of the screw rotor (40) and the gate rotor (51) are shifted, the gate rotor (51) made of a resin is excessively pressed against the screw rotor (40) and is thereby worn. Wear of the gate rotor (51) causes a refrigerant to leak from the compression chamber (32) and thereby causes deterioration of the performance of the screw compressor (10).

In contrast, in each gate rotor assembly (50) in the present embodiment, the axial movement of the gate rotor (51) is restricted since the gate rotor (51) is in contact with and sandwiched between the first support member (56) and the second support member (58). Meanwhile, since the gap (G) is formed between the inner peripheral surface of the concave portion (78) of the gate portion (72) of each of the gate blocks (70) and the outer peripheral surface of the protruding portion (93) of the second support member (58) so as to surround the entire circumference of the protruding portion (93), each of the gate blocks (70) is configured to be movable slightly in the circumferential direction and the radial direction on the front surface of the first support member (56). In other words, the gap (G) allows positional displacement of the gate rotor (51) caused by thermal expansion. Consequently, even when a change in the relative position of the gate rotor (51) with respect to the screw rotor (40) is generated by thermal expansion, the gate rotor (51) and the screw rotor (40) can mesh with each other normally since the position of the gate rotor (51) changes by following the screw rotor (40) due to the gap (G). As a result, wear of the gate rotor (51) can be suppressed.

(3) Driving Operation

In the screw compressor (10), the screw rotor (40) is driven by the electric motor (17). When the screw rotor (40) rotates, the gate rotor assemblies (50) meshing with the screw rotor (40) rotate. When the gate rotor assemblies (50) rotate, the gates (53) of the gate rotors (51) enter the helical grooves (41) of the screw rotor (40) and relatively move from the suction-side end (42) toward the discharge-side end (43) of the helical grooves (41) that the gates (53) have entered. As a result, the capacity of the compression chamber (32) is gradually reduced, and the refrigerant in the compression chamber (32) is compressed.

A low-pressure gas refrigerant that has flowed out from the evaporator (5) is sucked into the screw compressor (10) through the suction port (14). The gas refrigerant that has flowed into the low-pressure space (S1) through the suction port (14) flows into the compression chamber (32) and is compressed. The compressed gas refrigerant is discharged into the high-pressure space (S2). The refrigerant that has flowed into the high-pressure space (S2) is discharged to the outside of the screw compressor (10) through the discharge port (15). The high-pressure gas refrigerant discharged through the discharge port (15) flows toward the radiator (3).

(4) Features (4-1)

The gate rotor assemblies (50) each include the gate rotor (51) made of a resin and in which a plurality of the flat plate-shaped gates (53) that mesh with the helical grooves (41) of the screw rotor (40) are radially formed; the first support member (56) made of a metal and including a plurality of the first gate support portions (84) that each support a corresponding one of the gates (53) from the back surface side of the corresponding gate (53), the first support member (56) supporting the gate rotor (51) such that the gate rotor (51) is rotatable; and the second support member (58) made of a metal and including a plurality of the second gate support portions (92) that each support a corresponding one of the gates (53) from the front surface side of the corresponding gate (53).

Since each of the gate rotor assemblies (50) includes the second support member (58) made of a metal and including the second gate support portions (92) that each support a corresponding one of the gates (53) from the front surface side, it is possible to reinforce the gates (53) against a pressure that acts in a direction from the back surface toward the front surface of the gates (53) during operation of the screw compressor (10). Consequently, it is possible to increase strength against a pressure generated in a direction opposite to a normal direction during operation of the screw compressor (10).

(4-2)

The gate rotor (51) is sandwiched between the first support member (56) and the second support member (58). Each of the second gate support portions (92) of the second support member (58) includes the protruding portion (93) protruding toward a corresponding one of the gates (53). In each of the plurality of gates (53), the concave portion (78) with which the protruding portion (93) of a corresponding one of the second gate support portions (92) engages is formed. The gap (G) is formed between the inner peripheral surface of the concave portion (78) and the outer peripheral surface of the protruding portion (93) so as to surround the entire circumference of the protruding portion (93).

Movement of the gate rotor (51) in the axis direction is restricted since the gate rotor (51) is sandwiched between the first support member (56) and the second support member (58). Meanwhile, since the gap (G) is formed between the inner peripheral surface of the concave portion (78) of each gate (53) and the outer peripheral surface of the protruding portion (93) of each of the second gate support portions (92) so as to surround the entire circumference of the protruding portion (93), the gate rotor (51) is movable in the radial direction and the circumferential direction.

Therefore, even when changes in the relative positions of the screw rotor (40) and the gate rotor assemblies (50) are generated by thermal expansion of the screw compressor (10), the gate rotor (51) and the screw rotor (40) can normally mesh with each other since the position of the gate rotor (51) changes by following the screw rotor (40) due to the gap (G). Consequently, it is possible to suppress wear of the gate rotor (51) caused by thermal expansion.

(4-3)

The gate rotor (51) includes a plurality of the gate blocks (70) each including one gate (53). Since the gate rotor (51) is divided into a plurality of gate blocks (70) as described above, it is possible to easily move each of the gate blocks (70) in accordance with the degree of thermal expansion.

With the gate rotor (51) divided into a plurality of the gate blocks (70), it is possible to manufacture each of the gate blocks (70) by injection molding and thus possible to reduce manufacturing costs.

(4-4)

The gate rotor (51) is made of a resin. Consequently, seizing of a sliding portion in meshing with the screw rotor (40) can be suppressed.

(4-5)

The gate rotor (51) is sandwiched between the first support member (56) and the second support member (58). The gates (53) are each held by the first support member (56) and the second support member (58) such that the gates (53) are movable slightly in the radial direction and the circumferential direction of the first support member (56).

Here, when a component of the screw compressor (10) thermally expands due to operation of the screw compressor (10), the relative positions of the screw rotor (40) and the gate rotor assembly (50) change. At this time, the gate rotor (51) is worn by being pressed against the screw rotor (40) with an excessive force.

Movement of the gate rotor (51) in the axis direction is restricted since the gate rotor (51) is sandwiched between the first support member (56) and the second support member (58). Meanwhile, the gate rotor (51) is movable in the radial direction and the circumferential direction since the gates (53) are each held by the first support member (56) and the second support member (58) such that the gates (53) are movable slightly in the radial direction and the circumferential direction of the first support member (56).

Therefore, even when changes in the relative positions of the screw rotor (40) and each gate rotor assembly (50) are generated by thermal expansion of the screw compressor (10), the gate rotor (51) and the screw rotor (40) can normally mesh with each other since the gates (53) slightly move in the radial direction and the circumferential direction and thereby cause the position of the gate rotor (51) to change by following the screw rotor (40). Consequently, it is possible to suppress wear of the gate rotor (51) caused by thermal expansion of a component.

(5) Modifications

The aforementioned embodiment may be modified into modifications described below. In the following description, differences from the aforementioned embodiment will be described basically.

(5-1) Modification 1

Figure 10:
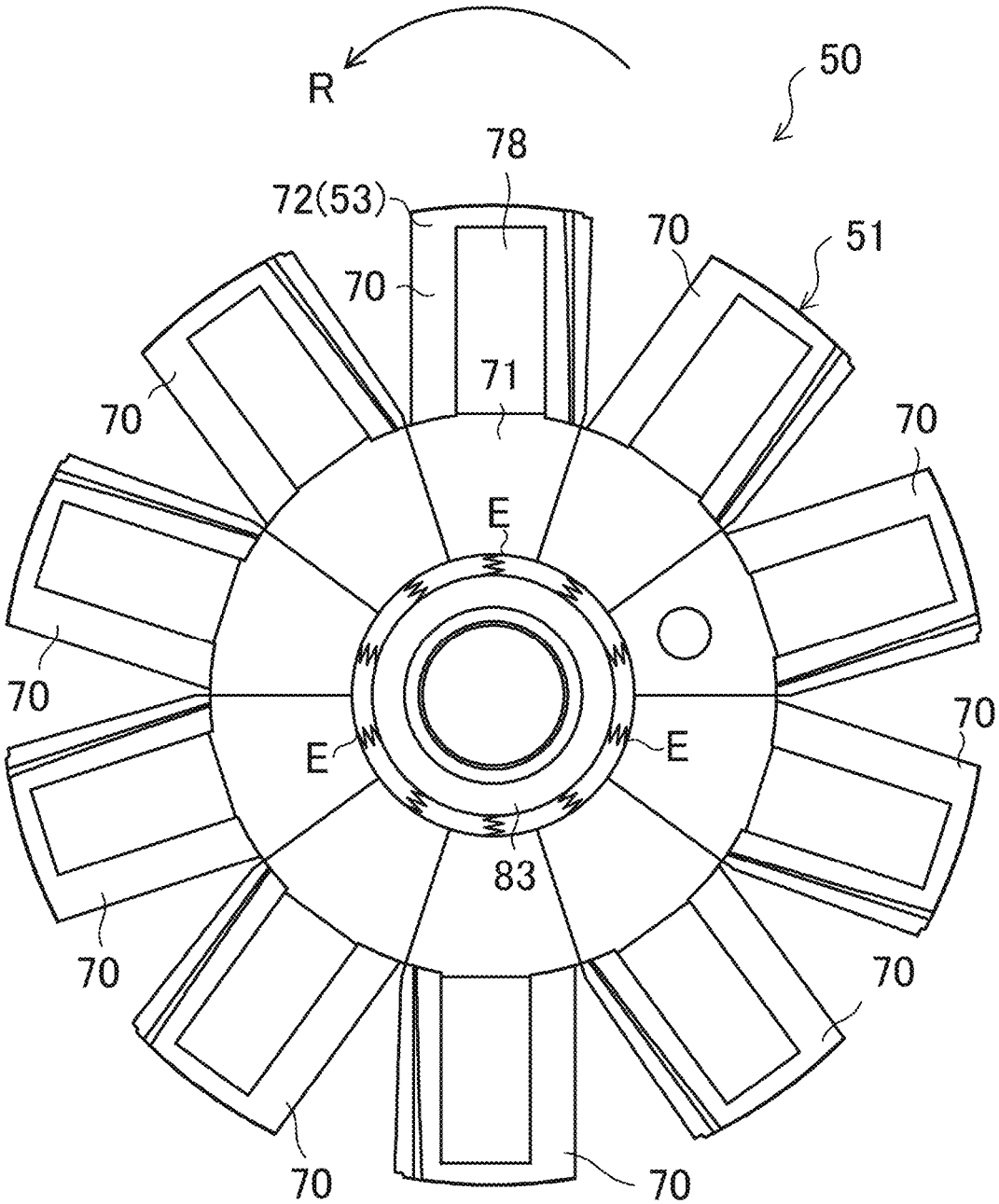
FIG. 10 is a diagram according to Modification 1 and corresponding to FIG. 5.

The gate rotor assembly (50) in the aforementioned embodiment may include an elastic body (E) that presses each of the gate blocks (70) against the screw rotor (40). Specifically, as illustrated in FIG. 10, the elastic body (E) is disposed between a base end portion of the base portion (71) of each of the gate blocks (70) and the second shaft portion (83) of the first support member (56). In the present modification, the elastic body (E) is a coil spring. The coil spring (E) presses each gate block (70) toward the outer side in the radial direction. The elastic body (E) may be made of a rubber material.

Each of the gate blocks (70) in the aforementioned embodiment is configured to be slightly movable in the circumferential direction and the radial direction on the front surface of the first support member (56). Therefore, when a centrifugal force generated by rotation of the screw compressor (10) does not sufficiently act on each of the gate blocks (70), a gap is formed between the leading end surface of each of the gate blocks (70) and the helical grooves (41) of the screw rotor (40).

Thus, in the present modification, the gate rotor assembly (50) includes the elastic body (E) that presses each of the gate blocks (70) against the screw rotor (40), thereby making it possible to suppress formation of a gap between the leading end surface of each gate block (70) and the helical grooves (41) of the screw rotor (40).

(5-2) Modification 2

Figure 11:
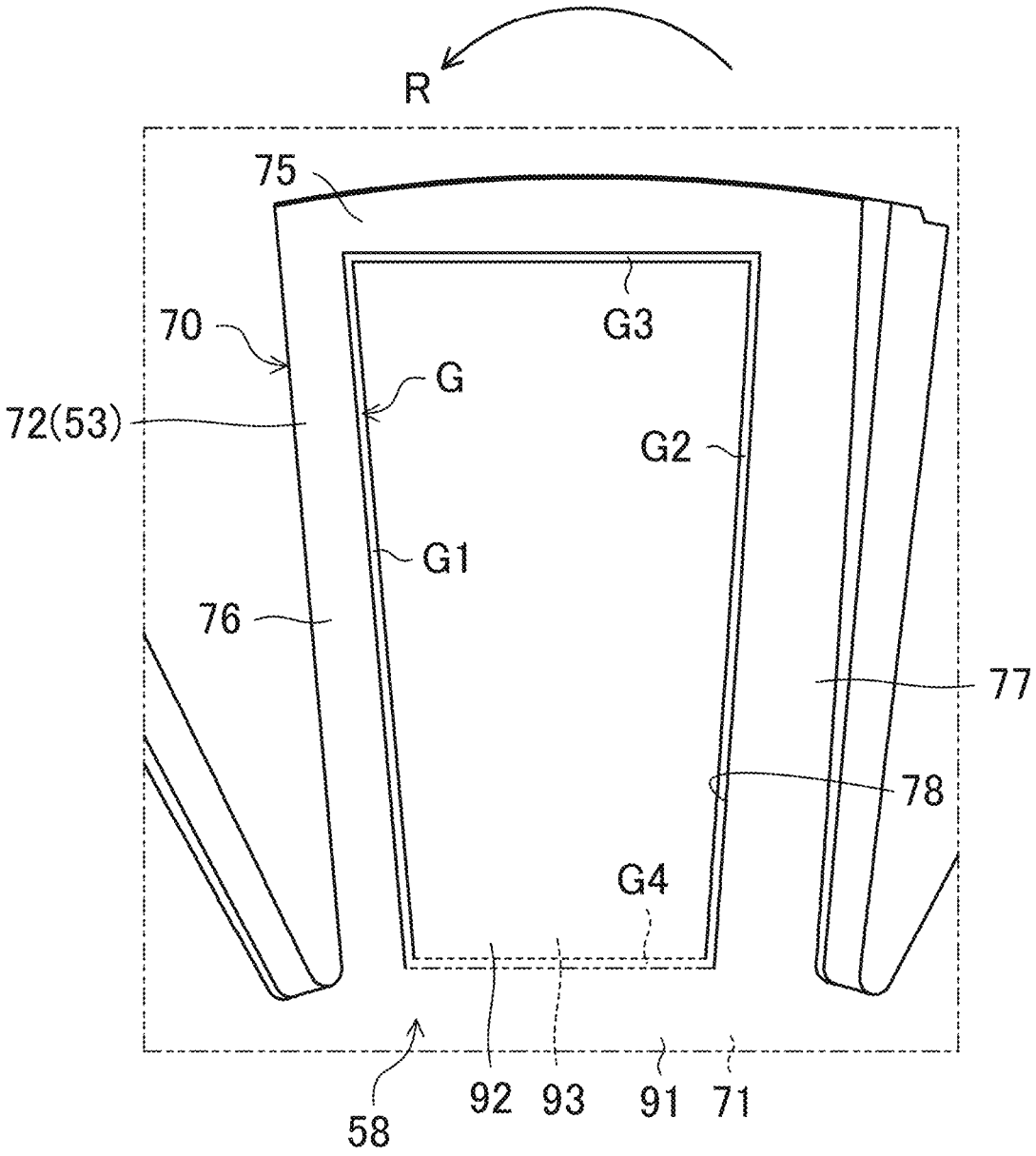
FIG. 11 is a diagram according to Modification 2 and corresponding to FIG. 8.

As illustrated in FIG. 11, the width of the gate portion (72) of each of the gate blocks (70) in the aforementioned embodiment may increase from the inner side toward the outer side in the radial direction of the gate rotor (51). In other words, the gate portion (72) may have a fan shape.

As described in Modification 1, a gap is formed between the leading end surface of each of the gate blocks (70) and the helical grooves (41) of the screw rotor (40) in the aforementioned embodiment when the centrifugal force acting on each of the gate blocks (70) is insufficient. Thus, in the present modification, the gate portion (72) has a fan shape to suppress coming-off of the gate blocks (70) from the helical grooves (41) when the gate rotor (51) meshes with the helical grooves (41) of the screw rotor (40).

(5-3) Modification 3

Figure 12:
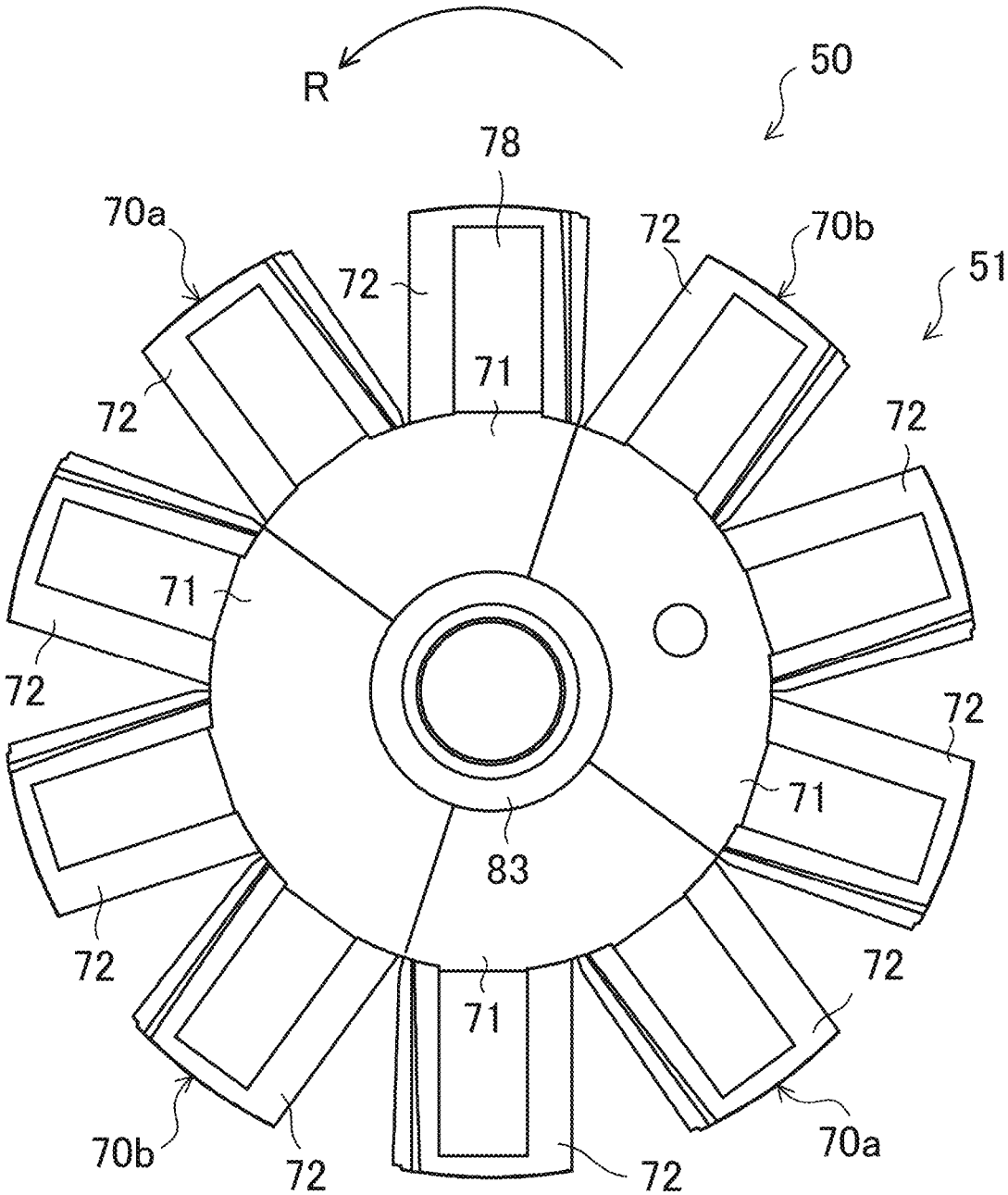
FIG. 12 is a diagram according to Modification 3 and corresponding to FIG. 5.

The gate blocks (70) in the aforementioned embodiment may each include a plurality of the gate portions (72). Specifically, for example, as illustrated in FIG. 12, the gate rotor (51) includes the first gate block (70*a*) that includes one base portion (71) and two gate portions (72), and the second gate block (70*b*) that includes one base portion (71) and three gate portions (72). As in the aforementioned embodiment, it is also possible in the present modification to obtain an effect that each of the gate blocks (70) is easily moved in accordance with the degree of thermal expansion.

(5-4) Modification 4

Figure 13:
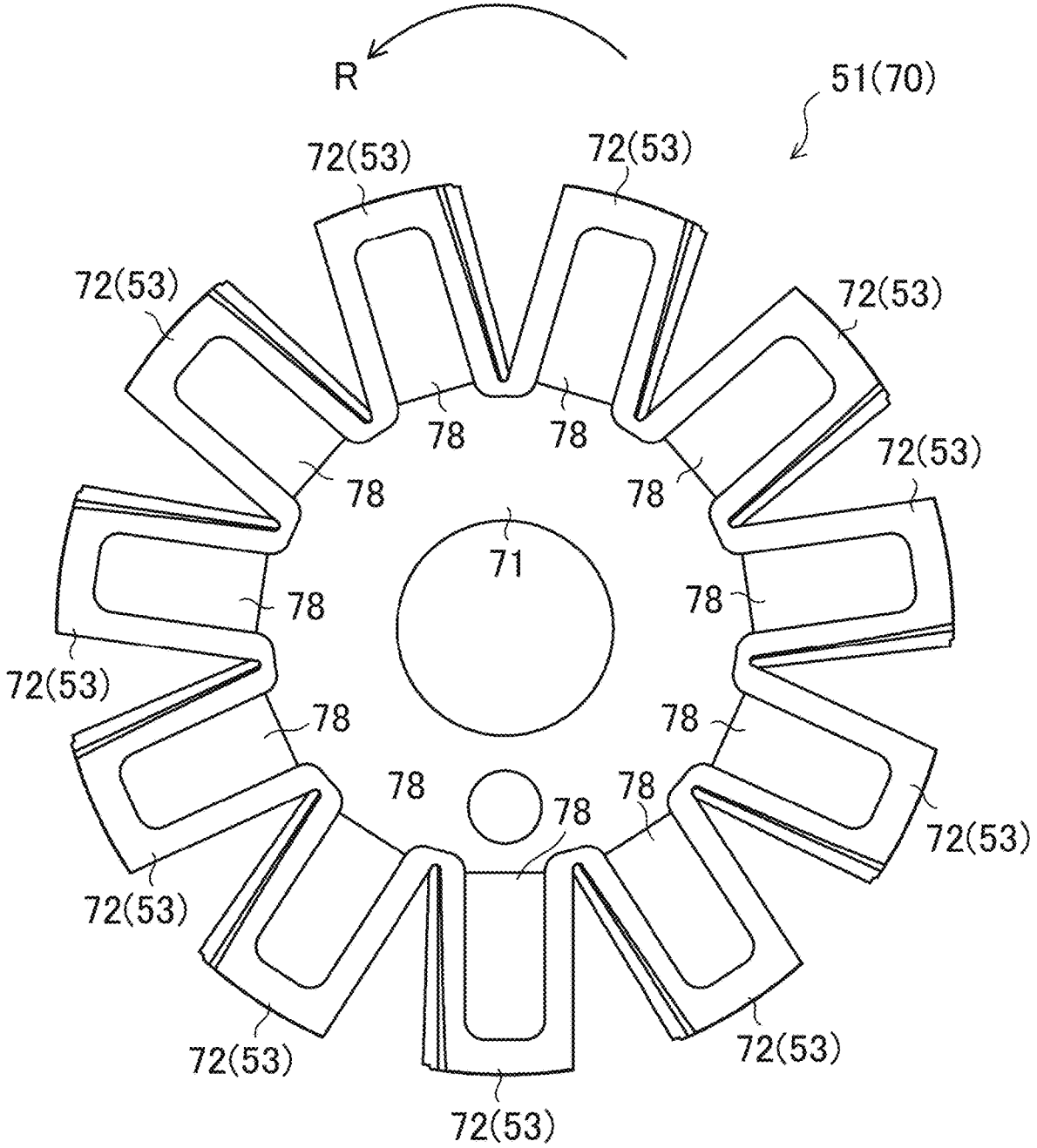
FIG. 13 is a plan view of a gate rotor according to Modification 4.

As illustrated in FIG. 13, the gate rotor (51) in the aforementioned embodiment may be formed integrally without being divided into a plurality of the gate blocks (70). It is also possible in the present modification to suppress wear of the gate rotor (51) caused by thermal expansion since the gap (G) is formed between the concave portion (78) of the gate portion (72) and the protruding portions (93) of the second gate support portions (92). In FIG. 13, an example in which the gate rotor (51) is provided with eleven gates (53) is illustrated.

(5-5) Modification 5

The gate rotor (51) in the aforementioned embodiment may be provided in a screw compressor that performs two-stage compression. In the screw compressor that performs two-stage compression, for example, a compression chamber (32) on the lower side of the screw rotor (40) serves as a first compression chamber, and a compression chamber (32) on the upper side of the screw rotor (40) serves as a second compression chamber. A refrigerant that has flowed into the low-pressure space (S1) through the suction port (14) flows into the first compression chamber and is compressed. The refrigerant that has been compressed in the first compression chamber and discharged flows into the second compression chamber through a passage formed inside the casing (11). The refrigerant that has flowed into the second compression chamber is compressed and then discharged into the high-pressure space (S2).

(5-6) Modification 6

The gate rotor (51), which is made of a resin in the aforementioned embodiment, may be made of a material other than resins. For example, the gate rotor (51) may be made of a metal.

(5-7) Modification 7

The gap (G) of the gate rotor assembly (50) in the aforementioned embodiment may be formed between a concave portion formed on the second gate support portion (92) and a protruding portion formed on the gate portion (72). In other words, in the present modification, the concave portion may be formed on the member on which the protruding portion in the aforementioned embodiment is formed while the protruding portion is formed on the member on which the concave portion in the aforementioned embodiment is formed.

As in the aforementioned embodiment, it is also possible in the present modification for the gate rotor (51) to move in the radial direction and the circumferential direction since the gap (G) is formed between the inner peripheral surface of the concave portion of each of the second gate support portions (92) and the outer peripheral surface of the protruding portion of the gate portion (72) so as to surround the entire circumference of the protruding portion.

Therefore, even when changes in the relative positions of the screw rotor (40) and the gate rotor assemblies (50) are generated by thermal expansion of the screw compressor (10), the gate rotor (51) and the screw rotor (40) can normally mesh with each other since the position of the gate rotor (51) changes by following the screw rotor (40) due to the gap (G). Consequently, it is possible to suppress wear of the gate rotor (51) caused by thermal expansion of a component.

While an embodiment and modifications have been described above, it should be understood that various changes in forms and details are available without deviating from the gist and the scope of the claims. In addition, elements in the embodiment and modifications described above and other embodiments may be combined, as appropriate, or replaced.

The terms such as "first", "second", "third" . . . are used for distinction between words to which these terms are given, and the terms are not intended to limit the number or order of the words.

As described above, the present disclosure is useful for a screw compressor and a refrigeration apparatus.

The invention claimed is:

1. A screw compressor comprising a casing;

a screw rotor accommodated in the casing, the screw rotor being configured to be rotationally driven; and a gate rotor assembly configured to rotate with rotation of the screw rotor, the gate rotor assembly including a gate rotor including a plurality of flat plate-shaped gates each configured to mesh with a helical groove of the screw rotor, a first support member made of a metal and including a plurality of first gate support portions each configured to support a corresponding one of the gates from a back surface side of the corresponding one of the gates, the first support member being configured to support the gate rotor such that the gate rotor is rotatable, and a second support member made of a metal and including an annular portion having an annular shape and a plurality of second gate support portions each extending radially toward an outer side from an outer peripheral portion of the annular portion and each configured to support a corresponding one of the gates from a front surface side of the corresponding one of the gates, each of the second gate support portions being configured to support a corresponding one of the gates to reinforce the corresponding one of the gates against a pressure that acts in a direction from a back surface toward a front surface of the corresponding one of the gates, the annular portion and the second support member being formed to be integrated with each other, and the first support member and the second support member sandwiching and holding the gate rotor therebetween.

2. The screw compressor according to claim 1, wherein the gate rotor is sandwiched between the first support member and the second support member, and the gates are each held by the first support member and the second support member such that the gates are movable slightly in a radial direction and a circumferential direction of the first support member.

3. The screw compressor according to claim 2, wherein the gate rotor includes a first gate block including one or a plurality of the gates and a second gate block including one or a plurality of the gates.

4. The screw compressor according to claim 3, wherein the gate rotor assembly further includes an elastic body configured to press each of the first gate block and the second gate block against the screw rotor.

5. The screw compressor according to claim 3, wherein the gates of the first gate block and the gates of the second gate block each have a width that increases from an inner side toward an outer side in a radial direction of the gate rotor.

6. A refrigeration apparatus including the screw compressor according to claim 1.

7. A screw compressor comprising:

a casing;

a screw rotor accommodated in the casing, the screw rotor being configured to be rotationally driven; and a gate rotor assembly configured to rotate with rotation of the screw rotor, the gate rotor assembly including a gate rotor including a plurality of flat plate-shaped gates each configured to mesh with a helical groove of the screw rotor, a first support member made of a metal and including a plurality of first gate support portions each configured to support a corresponding one of the gates from a back surface side of the corresponding one of the gates, the first support member being configured to support the gate rotor such that the gate rotor is rotatable, and a second support member made of a metal and including a plurality of second gate support portions each configured to support a corresponding one of the gates from a front surface side of the corresponding one of the gates, the gate rotor being sandwiched between the first support member and the second support member, and the gates being each held by the first support member and the second support member such that the gates are movable slightly in a radial direction and a circumferential direction of the first support member, each of the second gate support portions of the second support member including a protruding portion protruding toward a corresponding one of the gates, a concave portion with which the protruding portion of a corresponding one of the second gate support portions engages being formed on each of the plurality of gates, and a gap being formed between an inner peripheral surface of the concave portion and an outer peripheral surface of the protruding portion so as to surround an entire circumference of the protruding portion.

8. A refrigeration apparatus including the screw compressor according to claim 7.

* * * * *